US008479507B2

(12) United States Patent
Katayama et al.

(10) Patent No.: US 8,479,507 B2
(45) Date of Patent: Jul. 9, 2013

(54) PISTON ENGINE

(75) Inventors: Masaaki Katayama, Susono (JP); Daisaku Sawada, Gotemba (JP); Hiroshi Yaguchi, Susono (JP)

(73) Assignee: Toyota Jidosha Kabushiki Kaisha, Toyota-shi (JP)

( * ) Notice: Subject to any disclaimer, the term of this patent is extended or adjusted under 35 U.S.C. 154(b) by 880 days.

(21) Appl. No.: 12/634,845

(22) Filed: Dec. 10, 2009

(65) Prior Publication Data

US 2010/0139263 A1 Jun. 10, 2010

(30) Foreign Application Priority Data

Dec. 10, 2008 (JP) ..... 2008-314599

(51) Int. Cl.
*F01B 29/10* (2006.01)

(52) U.S. Cl.
USPC ..... 60/524; 60/526

(58) Field of Classification Search
USPC ..... 60/517–526
See application file for complete search history.

(56) References Cited

U.S. PATENT DOCUMENTS

| | | | | |
|---|---|---|---|---|
| 3,889,465 | A * | 6/1975 | Gartner | 60/521 |
| 4,215,548 | A * | 8/1980 | Beremand | 60/520 |
| 4,327,550 | A * | 5/1982 | Knoos | 60/522 |
| 4,856,280 | A * | 8/1989 | Chagnot | 60/522 |
| 7,581,393 | B2 * | 9/2009 | Yaguchi et al. | 60/521 |

FOREIGN PATENT DOCUMENTS

| | | |
|---|---|---|
| JP | 2005106009 A | 4/2005 |
| JP | 2006348893 | 12/2006 |
| JP | 2008267258 A | 11/2008 |

OTHER PUBLICATIONS

Japanese Patent Application No. JP 2008-321553.

* cited by examiner

*Primary Examiner* — Hoang Nguyen
(74) *Attorney, Agent, or Firm* — Gifford, Krass, Sprinkle, Anderson & Citkowski, P.C.

(57) ABSTRACT

A Stirling engine has a fluid passage that connects a low temperature-side actuating fluid space and a crankcase inner space, and a passage opening/closing valve that is provided in the fluid passage and that opens and closes the fluid passage. The passage opening/closing valve enables communication through the fluid passage upon startup of the Stirling engine, and shuts off communication through the fluid passage when the rotational speed of the crankshaft of the Stirling engine is equal to or greater than a pre-established start-enabling rotational speed.

9 Claims, 6 Drawing Sheets

PISTON ENGINE

INCORPORATION BY REFERENCE

The disclosure of Japanese Patent Application No. 2008-314599 filed on Dec. 10, 2008 including the specification, drawings and abstract is incorporated herein by reference in its entirety.

BACKGROUND OF THE INVENTION

1. Field of the Invention

The invention relates to a piston engine in which an actuating fluid space is filled with an actuating fluid.

2. Description of the Related Art

Recent years have witnessed growing interest in Stirling engines, which have excellent theoretical thermal efficiency, for recovering waste heat from internal combustion engines installed in cars, buses, trucks and the like, and also waste heat in factories. Stirling engines, which are a kind of piston engine, have an actuating fluid space filled with a high-pressure actuating fluid. For instance, Japanese Patent Application Publication No. 2006-348893 (JP-A-2006-348893) discloses a Stirling engine in which the interior of a crankcase is pressurized.

The actuating fluid space of the Stirling engine is filled with an actuating fluid, and hence the Stirling engine cannot start up unless the piston moves reciprocally by being acted upon by a force that is greater than the maximum pressure of the actuating fluid. The interior of the crankcase of the Stirling engine disclosed in JP-A-2006-348893 is pressurized, and hence the pressure of the actuating fluid in the actuating fluid space is accordingly high. This is problematic in that, as a result, substantial torque is required for starting the Stirling engine, and there must be provided some start means having significant torque for starting the Stirling engine. This entails considerable wastes.

SUMMARY OF THE INVENTION

The invention provides a piston engine, having an actuating fluid space filled with an actuating fluid, that requires less torque during startup.

In an aspect of the invention, a piston engine includes: a cylinder; a piston that moves reciprocally in the cylinder wherein the piston engine converts the reciprocating motion of the piston into rotational motion and outputs the rotational motion; a fluid passage that connects a first space formed in the cylinder and filled with an actuating fluid, with a second space on an opposite side of the piston to the first space; and a passage opening/closing portion that is provided in the fluid passage and that switches between communication and non-communication through the fluid passage wherein the passage opening/closing portion enables communication through the fluid passage upon startup of the piston engine, and shuts off communication through the fluid passage when the rotational speed of the piston engine is equal to or greater than a predetermined rotational speed.

The predetermined rotational speed may be a start-enabling rotational speed at which the piston compresses the actuating fluid, in a state where communication through the fluid passage is shut off, and at which an inertial energy of the rotational system of the piston engine that corresponds to a magnitude in excess of a maximum pressure of the actuating fluid can be obtained.

Upon startup, the above piston engine may be placed in a virtually load-less state, and the passage opening/closing portion may open the fluid passage until attainment of a rotational speed at which the piston and the cylinder are not in contact.

The above piston engine may be a Stirling engine having: a first cylinder; a first piston that moves reciprocally in the first cylinder; a second cylinder; a second piston that moves reciprocally in the second cylinder; and a heat exchanger that has a heater that heats the actuating fluid and is connected to the first cylinder, so that the actuating fluid flows in and out of the heater, a regenerator connected to the heater, so that the actuating fluid flows in and out of the regenerator, and a cooler that cools the actuating fluid, the cooler having one end connected to the regenerator and the other end connected to the second cylinder, so that the actuating fluid flows in and out of the cooler; and wherein a gas bearing is interposed between the first cylinder and the first piston, and between the second cylinder and the second piston, and the fluid passage connects a portion closer to the cooler than the top dead center of the second piston and a portion closer to the second space than the bottom dead center of the second piston.

The invention allows reducing the torque for starting up a piston engine that has an actuating fluid space filled with an actuating fluid.

BRIEF DESCRIPTION OF THE DRAWINGS

The foregoing and further objects, features and advantages of the invention will become apparent from the following description of example embodiments with reference to the accompanying drawings, wherein like numerals are used to represent like elements and wherein.

DETAILED DESCRIPTION OF THE EMBODIMENTS

Embodiments of the invention are explained next in detail with reference to accompanying drawings. The invention is in no way meant to be limited by the explanation below. The constituent elements in the embodiments below encompass so-called equivalent constituent elements, such as constituent elements easily conceivable by a person skilled in the art, or substantially identical constituent elements. In the explanation below, a Stirling engine is illustrated as an example of a piston engine, but the piston engine is not limited to a Stirling engine. The explanation below relates to an example where the waste heat of an internal combustion engine installed in a vehicle or the like is recovered by way of a Stirling engine, which is a piston engine. However, the object of waste heat recovery is not limited to an internal combustion engine. The invention can be used, for instance, for waste heat recovery in factories, plants and power generation facilities.

Embodiment 1

The piston engine according to the embodiment 1 has a structure in which a gas bearing is interposed between a piston and a cylinder. Accordingly, an actuating fluid is introduced, for instance, from an actuating fluid space in the cylinder into a pressure-accumulating space that is enclosed by the outer shell of the piston and by a partition member inside the piston. The actuating fluid is caused to flow out of gas supply holes, provided in the lateral portion of the piston, into the gap between the piston and the cylinder. A gas bearing forms as a result between the piston and the cylinder. In the embodiment 1, such a piston engine is provided with a fluid passage that connects a first space filled with the actuating fluid, with a second space on the side of the piston opposite the first space; and a passage opening/closing means that opens and closes the fluid passage. The passage opening/closing means opens the fluid passage, enabling communication therethrough, upon startup of the piston engine according to the embodiment 1, and closes the fluid passage, shutting off communication therethrough, when the engine rotational speed of the piston engine is equal to or greater than a predetermined rotational speed established beforehand. The gas bearing may be a static-pressure gas bearing or a dynamic-pressure gas bearing. The engine rotational speed of the piston engine refers to the rotational speed of the output shaft of the piston engine. The rotational speed of the crankshaft becomes the engine rotational speed when the reciprocating motion of the piston is converted into rotational motion by the crankshaft and is extracted therefrom.

Figure 1:
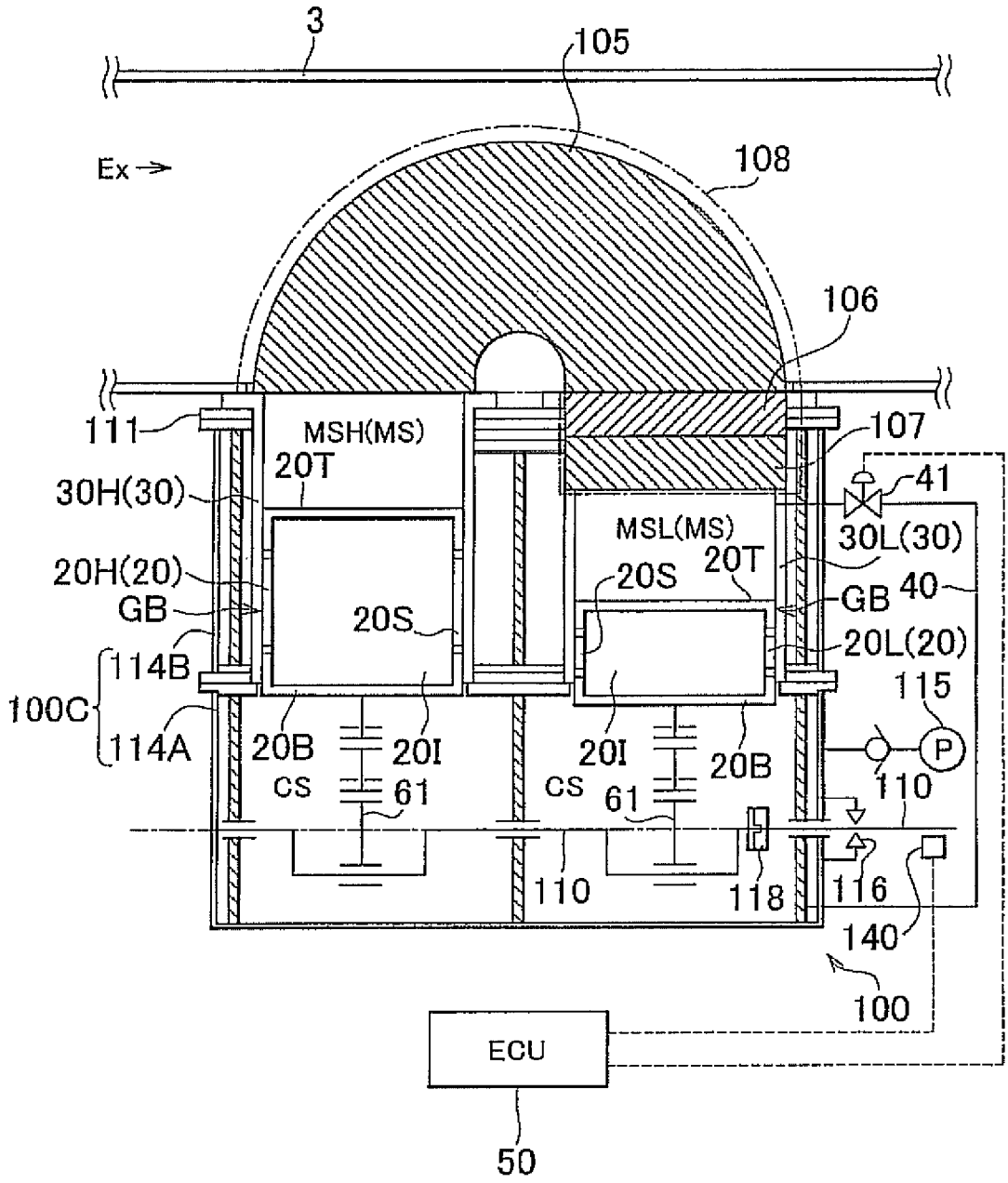
FIG. 1 is a cross-sectional diagram illustrating the configuration of a Stirling engine as a piston engine according to Embodiment 1.
Figure 2:
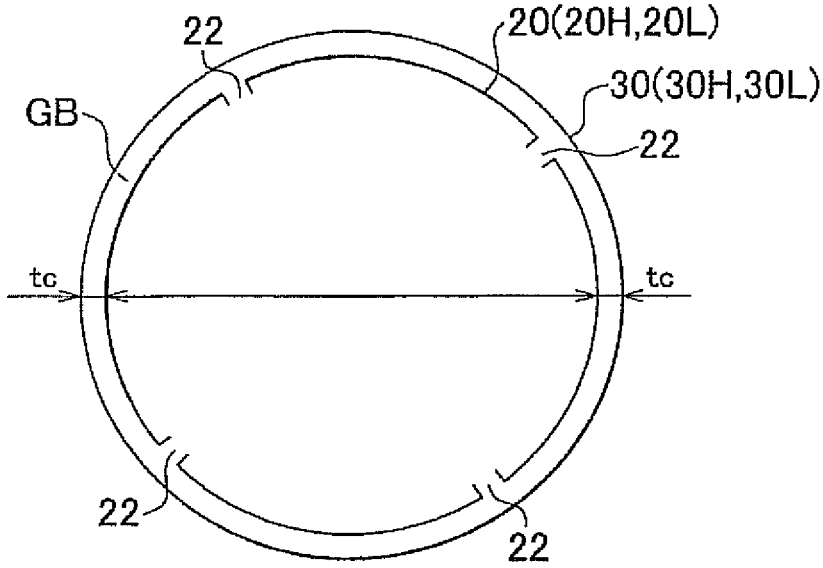
FIG. 2 is a plan-view diagram illustrating a gas bearing in the Stirling engine according to Embodiment 1.
Figure 3:
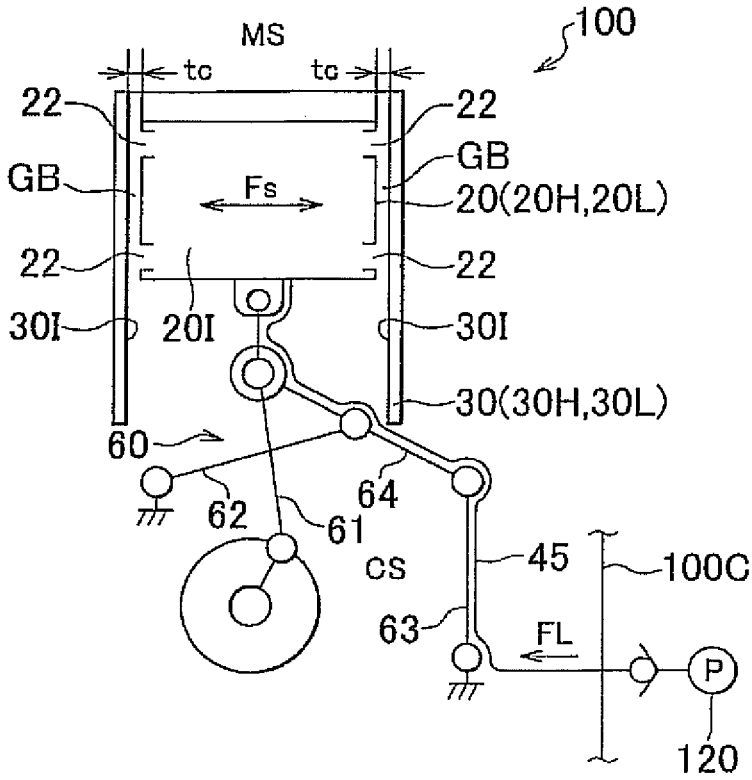
FIG. 3 is an explanatory diagram illustrating an example of the configuration of the gas bearing in the Stirling engine according to Embodiment 1, and illustrating a support structure of a piston.

FIG. 1 is a cross-sectional diagram illustrating the configuration of a Stirling engine as a piston engine according to Embodiment 1. FIG. 2 is a plan-view diagram illustrating a gas bearing in the Stirling engine according to Embodiment 1. FIG. 3 is an explanatory diagram illustrating an example of the configuration of the gas bearing in the Stirling engine according to Embodiment 1, and illustrating a support structure of a piston. A Stirling engine 100 as the piston engine according to Embodiment 1 is a so-called alpha-type inline dual-cylinder Stirling engine. In the embodiment 1, the Stirling engine 100 has a heat exchanger 108 disposed in a heater case 3 that functions as a passage through which there flows exhaust gas Ex from an internal combustion engine. The Stirling engine 100 is used thus as a waste heat recovery device that recovers thermal energy from the exhaust gas Ex of a thermal engine (for instance, an internal combustion engine).

In the Stirling engine 100 there are serially arranged a high temperature-side piston 20H, as a first piston, housed in a high temperature-side cylinder 30H, as a first cylinder; and a low temperature-side piston 20L, as a second piston, housed in a low temperature-side cylinder 30L, as a second cylinder. Hereafter, the high temperature-side cylinder 30H and the low temperature-side cylinder 30L will be referred to as cylinder 30 when no distinction is made between the two cylinders. Likewise, the high temperature-side piston 20H and the low temperature-side piston 20L will be referred to as piston 20 when no distinction is made between the two pistons. In the Stirling engine 100 according to Embodiment 1, as described below, gas bearings GB are interposed between the high temperature-side cylinder 30H and the high temperature-side piston 20H, and between the low temperature-side cylinder 30L and the low temperature-side piston 20L.

The high temperature-side cylinder 30H and the low temperature-side cylinder 30L are supported on, and fixed to, directly or indirectly, a base 111, as a reference body. In the embodiment 1, the base 111 provided in the Stirling engine 100 is a positional reference of the various constituent elements of the Stirling engine 100. Such a configuration allows securing the relative positional precision among the various constituent elements, and allows therefore maintaining the clearance between pistons and cylinders with good precision. The function of the gas bearings GB can be fully brought out as a result.

The heat exchanger 108, which has a heater 105, a regenerator 106 and a cooler 107, is provided between the high temperature-side cylinder 30H and the low temperature-side cylinder 30L. One end of the heater 105 is connected to the high temperature-side cylinder 30H, so that an actuating fluid flows in and out between the heater 105 and the high temperature-side cylinder 30H. In the heater 105, the actuating fluid is heated by heat from the exhaust gas Ex that comes from the internal combustion engine and that flows through a heater case 3. The heated actuating fluid flows into the high temperature-side cylinder 30H. The heater 105 can have a plurality of tubes of a material having high thermal conductivity and excellent thermal resistance. In the embodiment 1, the heater 105 is substantially U-shaped. As a result, the heater 105 can be disposed easily in comparatively narrow spaces, for instance in the exhaust gas passages of an internal combustion engine. The other end of the heater 105, i.e. the end on the opposing side to the high temperature-side cylinder 30H, is connected to the regenerator 106. Actuating fluid flows in and out between the heater 105 and the regenerator 106.

The end of the regenerator 106 on the opposite side to the end connected to the heater 105 is connected to the cooler 107, to enable inflow of actuating fluid from the heater 105 or the cooler 107. The regenerator 106 may have, for instance, a porous heat-storage material. The end of the cooler 107 on the opposite side to the end connected to the regenerator 106 is connected to the low temperature-side cylinder 30L. That is, one end of the cooler 107 is connected to the regenerator 106 while the other end is connected to the low temperature-side cylinder 30L. The actuating fluid flows in and out between the cooler 107 and the low temperature side cylinder 30L. The cooler 107 cools the actuating fluid that flows through the regenerator 106. The cooler 107 can have a plurality of tubes of a material having high thermal conductivity and excellent thermal resistance. The cooler 107 may rely on air cooling or water cooling. In the embodiment 1, the heat exchanger 108 is configured as described above in such a manner that actuating fluid passing through the heat exchanger 108 flows in and out of the high temperature-side cylinder 30H and the low temperature side cylinder 30L.

The interior of the high temperature-side cylinder 30H, the low temperature side cylinder 30L and the heat exchanger 108 is filled with an actuating fluid (air, in the embodiment 1). The Stirling engine 100 is driven on account of the heat supplied by the heater 105. A Stirling cycle is thus established, as described above. The space of the high temperature-side cylinder 30H filled with the actuating fluid is called a high temperature-side actuating fluid space MSH, while the space of the low temperature-side cylinder 30L filled with the actuating fluid is called a low temperature-side actuating fluid space MSL. When no distinction is made between the above two, they will be simply referred to as actuating fluid space MS.

The high temperature-side piston 20H and the low temperature-side piston 20L are supported in the high temperature-side cylinder 30H and the low temperature side cylinder 30L by way of respective gas bearings GB. That is, the pistons are supported in the cylinders by means of a structure having no piston rings and employing no lubricant. Friction between the pistons and the cylinders is reduced as a result, which allows increasing the efficiency of the Stirling engine 100. The reduction in friction between the pistons and the cylinders allows the Stirling engine 100 to recover thermal energy out of waste heat, even when the Stirling engine 100 is used under operation conditions that involve low thermal sources and low temperature differences, for instance in the recovery of waste heat from an internal combustion engine.

To configure the gas bearings GB, a predetermined clearance to is left between the piston 20 (high temperature-side piston 20H, low temperature-side piston 20L) and the cylinder 30 (high temperature-side cylinder 30H, low temperature side cylinder 30L), as illustrated in FIG. 2. The clearance ic, which ranges from several μm to several tens of μm, runs around the entire periphery of the piston 20. The reciprocating motion of the high temperature-side piston 20H and the low temperature-side piston 20L is transmitted to a crankshaft 110, as an output shaft, by way of a connecting rod 61, to be converted into rotational motion.

The gas bearings GB have low ability (load ability) for resisting a force in the diameter direction (horizontal direction, thrust direction) of the piston 20. Therefore, the side force Fs of the piston 20 is preferably set to substantially 0. It becomes therefore necessary to increase the linear motion precision of the piston 20 in the axis (center axis) of the cylinder 30. To this end, the high temperature-side piston 20H and the low temperature-side piston 20L in the embodiment 1 are supported by an approximate linear mechanism (for instance, a grasshopper mechanism) 60, as illustrated in FIG. 3.

The approximate linear mechanism 60 in the embodiment 1 utilizes a grasshopper mechanism. The approximate linear mechanism 60 has a first arm 62, one end of which is pivotably mounted on a chassis 100C of the Stirling engine 100; a second arm 63 having likewise one end pivotably mounted on the chassis 100C of the Stirling engine 100; and a third arm 64, having one end pivotably coupled to the end of the connecting rod 61 and the other end pivotably coupled to the other end of the second arm 63. An end of the connecting rod 61 other than the end pivotably mounted to the crankshaft 110 is pivotably coupled to the end of the third arm 64. The other end of the first arm 62 is pivotably coupled to halfway between both ends of the third arm 64.

Using an approximate linear mechanism 60 having such a configuration allows the high temperature-side piston 20H and the low temperature-side piston 20L to execute a substantially linear reciprocating motion. As a result, the side force Fs of the high temperature-side piston 20H and the low temperature-side piston 20L becomes virtually 0, so that the pistons 20 can be sufficiently supported by the gas bearings GB that have little load ability. The approximate linear mechanism 60 that supports the piston 20 is not limited to a grasshopper mechanism, and may be a Watt linkage or the like.

The dimensions required for achieving the same linear motion precision can be smaller in the grasshopper mechanism used as the approximate linear mechanism 60 in the embodiment 1, as compared with other approximate linear mechanisms. This is advantageous in that the Stirling engine 100 as a whole can be made more compact thereby. In particular, a compact Stirling engine 100 as a whole affords a greater degree of freedom as regards the arrangement of the Stirling engine 100 according to the embodiment 1 when the grasshopper mechanism is used for waste heat recovery in an internal combustion engine equipped with the Stirling engine 100, which is disposed to that end inside a limited space, for example, when arranging the heat exchanger 108 in the exhaust gas passage in the internal combustion engine. Moreover, the weight of the mechanism required for achieving the same linear motion precision is smaller in a grasshopper mechanism than in other mechanisms. This is advantageous in terms of enhancing thermal efficiency. Further, the grasshopper mechanism has a comparatively simple construction, and hence is advantageous in that the mechanism can be manufactured and assembled easily, with reduced manufacturing costs:

As illustrated in FIG. 1, the constituent elements of the Stirling engine 100, i.e. the high temperature-side cylinder 30H, the high temperature-side piston 20H, the connecting rod 61, the crankshaft 110 and so forth, are housed in the chassis 100C. The chassis 100C of the Stirling engine 100 includes a crankcase 114A and a cylinder block 114B. The space CS within the crankcase 114A (crankcase inner space) in the chassis 100C is filled with a gas. In the embodiment 1, the gas is the same as the actuating fluid of the Stirling engine 100. The gas that fills the crankcase inner space CS is pressurized by a pump 115 as a pressure adjustment means. The pump 115 may be driven, for instance, by the internal combustion engine whose waste heat is to be recovered by the Stirling engine 100, or may be driven by way of a driving means such as an electric motor.

In the Stirling engine 100, when the temperature difference between the heater 105 and the cooler 107 is the same, the pressure difference at the high-temperature side and the low-temperature side becomes higher as the average pressure of the actuating fluid increases, so that a higher output is obtained. In the Stirling engine 100 according to the embodiment 1, the actuating fluid in the actuating fluid space MS is kept at a high pressure through pressurization of the gas that fills the crankcase inner space CS. Greater output can be extracted thereby from the Stirling engine 100. As a result, greater output can be obtained from the Stirling engine 100 even when only a low-quality heat source can be used, as is the case in waste heat recovery. Herein, the output of the Stirling engine 100 increases substantially proportionally to the pressure of the gas that fills the chassis 100C. Also, the pump 115 may be omitted, and the gas that fills the crankcase inner space CS may be pressurized beforehand to a predetermined pressure.

A sealed bearing 116 is mounted to the chassis 100C of the Stirling engine 100. The crankshaft 110 is supported by the sealed bearing 116. Although the gas that fills the interior of the chassis 100C in the Stirling engine 100 is pressurized, leakage of gas that fills the interior of chassis 100C can be kept to a minimum by way of the sealed bearing 116. The output of the crankshaft 110 can be extracted out of the chassis 100C by way of, for instance, a flexible coupling 118 such as an Oldham coupling.

As illustrated in FIGS. 1 and 3, the piston 20 provided in the Stirling engine 100 has an outer shell having a top portion 20T, a side portion 208 and a bottom portion 20B, and a pressure-accumulating space 20I as the space enclosed by the top portion 20T, the side portion 20S and the bottom portion 20B. In the Stirling engine 100, actuating fluid FL is supplied into the pressure-accumulating space 20I of the piston 20 via a gas supply passage 45, by a gas bearing pump 120, as a gas bearing pressure generation means, that is disposed outside the chassis 100C. The actuating fluid FL that is infused into the pressure-accumulating space 20I passes through a plurality of gas supply holes 22 that are provided in the side portion 20S of the piston 20, and flows into the clearance tc between the side portion 20S of the piston 20 and an inner wall 30I of the cylinder 30. A gas bearing GB forms as a result between the piston 20 and the inner wall 30I of the cylinder 30.

In the embodiment 1, the gas that fills the interior of the crankcase inner space CS of the chassis 100C is pressurized. If the gas bearing pump 120 is disposed outside the chassis 100C, therefore, the actuating fluid FL cannot be caused to flow out of the pressure-accumulating space 20I, via the gas supply holes 22, unless the gas bearing pump 120 feeds the actuating fluid FL into the pressure-accumulating space 20I at least at a pressure higher than the pressure in the crankcase inner space CS. Such being the case, if the gas bearing pump 120 were provided inside the chassis 100C, the gas bearing pump 120 would need only feed already-pressurized actuating fluid FL into the pressure-accumulating space 20I. This would allow reducing the workload of the gas bearing pump 120 as required for forming the gas bearing GB.

The Stirling engine 100 illustrated in FIG. 1 has a fluid passage that connects a first space filled with the actuating fluid of the Stirling engine 100, as a piston engine, and a second space on the side of the piston 20 opposite the first space. The fluid passage is provided with a passage opening/closing means capable of opening/closing the fluid passage. In the Stirling engine 100 according to the embodiment 1, the high temperature-side actuating fluid space MSH or the low temperature-side actuating fluid space MSL, i.e. the actuating fluid space MS, corresponds to the first space, while the crankcase inner space CS corresponds to the second space. In the embodiment 1, the low temperature-side actuating fluid space MSL is connected to the crankcase inner space CS by way of a fluid passage 40. The fluid passage 40 has a passage opening/closing valve 41 as a passage opening/closing means.

The passage opening/closing valve 41 may have, for instance, a solenoid valve. As illustrated in FIG. 1, the passage opening/closing valve 41 is electrically connected to an electronic control unit (ECU) 50 for controlling the Stirling engine 100, so that opening/closing of the passage opening/closing valve 41 is controlled by the ECU 50. When the passage opening/closing valve 41 opens, the actuating fluid space MS and the crankcase inner space CS are connected with each other by way of the fluid passage 40. When the passage opening/closing valve 41 closes, the actuating fluid space MS and the crankcase inner space CS are shut off from each other.

The actuating fluid space MS and the crankcase inner space CS are shut off from each other when the passage opening/closing valve 41 closes during operation of the Stirling engine 100. The high temperature-side piston 20H and the low temperature-side piston 20L execute a reciprocating motion by virtue of changes in the pressure of the actuating fluid in the actuating fluid space MS and the heat exchanger 108, on account of the thermal energy received by the heater 105. This reciprocating motion is converted into rotational motion, and is outputted as such, by the crankshaft 110.

The Stirling engine 100 cannot start up by itself. For start up, therefore, it becomes necessary to impart reciprocating motion to the high temperature-side piston 20H and the low temperature-side piston 20L by way of a rotational force from the crankshaft 110. However, the actuating fluid space MS of the Stirling engine 100 is filled with high-pressure actuating fluid. Therefore, the crankshaft 110 cannot rotate, and the Stirling engine 100 cannot start up, unless a force is applied to the piston 20 in excess of the maximum pressure (maximum actuating fluid pressure) of the actuating fluid that fills the actuating fluid space MS of the piston 20.

To start up the Stirling engine 100 in the embodiment 1, the passage opening/closing valve 41 opens to communicate the actuating fluid space MS with the crankcase inner space CS by way of the fluid passage 40. This renders the pressure of the actuating fluid space MS and the pressure of the crankcase inner space CS substantially identical, so that if the crankshaft 110 is given a rotational force greater than the friction resistance force of the Stirling engine 100, the crankshaft 110 can rotate, and the piston 20 coupled to the crankshaft 110 can execute a reciprocating motion. As a result, the crankshaft 110 can be caused to rotate, in substantially a load-less state, by an external driving force (for instance, a starter motor). Once the rotational speed of the crankshaft 110 exceeds a pre-established start-enabling rotational speed N0, the passage opening/closing valve 41 closes to shut off the communication between the actuating fluid space MS and the crankcase inner space CS. The Stirling engine 100 is started up thereby, and begins running. The opening/closing timing of the passage opening/closing valve 41 is explained next.

Figure 4:
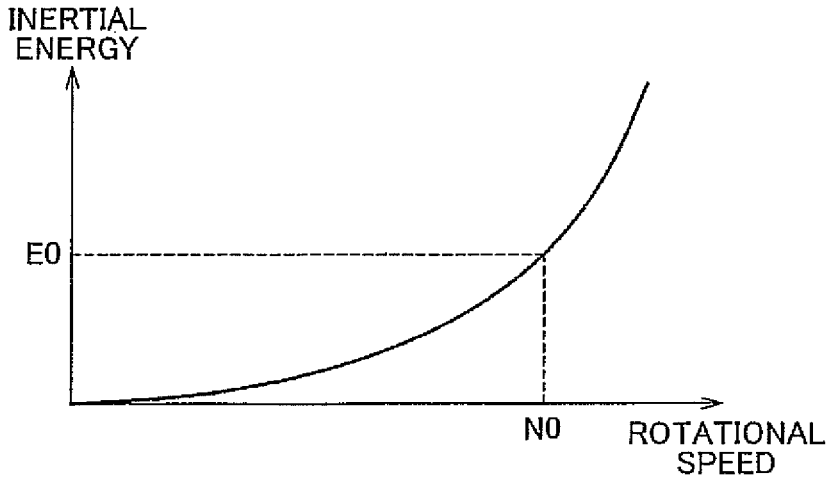
FIG. 4 is a conceptual diagram illustrating the relationship between the inertial energy of the rotational system of a Stirling engine and the rotational speed of an output shaft of the Stirling engine.
Figure 5A:
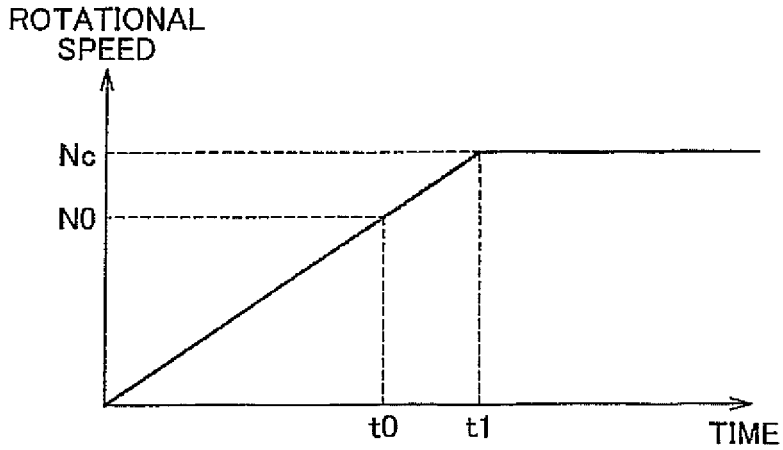
FIG. 5A is an explanatory diagram of the closing timing of a passage opening/closing valve.
Figure 5B:
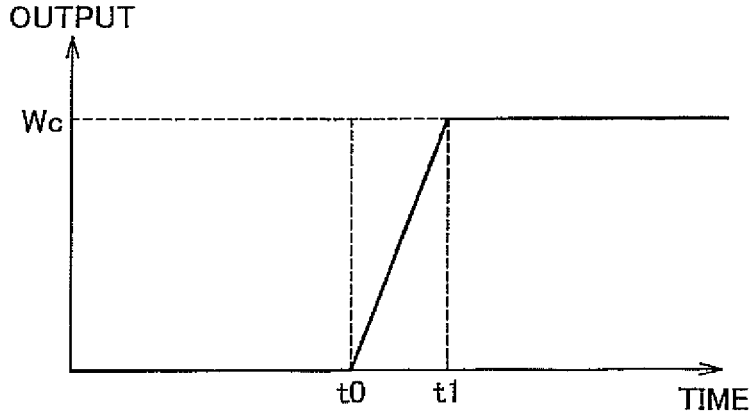
FIG. 5B is an explanatory diagram of the closing timing of a passage opening/closing valve.

FIG. 4 is a conceptual diagram illustrating the relationship between the inertial energy of the rotational system of a Stirling engine and the rotational speed of an output shaft of the Stirling engine. FIGS. 5A and 5B are explanatory diagrams of the closing timing of a passage opening/closing valve. In the embodiment 1, the piston 20 compresses the actuating fluid in the actuating fluid space MS in a state where the passage opening/closing valve 41 is closed, i.e. in a state where communication between the actuating fluid space MS and the crankcase inner space CS is shut off. The passage opening/closing valve 41 is closed at a timing at which the rotational speed reaches the start-enabling rotational speed N0 at which there is achieved an inertial energy E0 of the rotational system that corresponds to the magnitude by which the actuating fluid pressure in the actuating fluid space MS exceeds the maximum actuating fluid pressure Pmax (or a magnitude of the inertial energy E0 that exceeds the maximum actuating fluid pressure Pmax). When the passage opening/closing valve 41 is closed at such a timing, the piston 20 initiates a reciprocating motion with a force that exceeds the maximum actuating fluid pressure Pmax of the actuating fluid in the actuating fluid space MS, whereupon continued rotation by the crankshaft 110 allows the Stirling engine 100 to start up.

The rotational system is the rotational system of the Stirling engine 100. The rotational system of the Stirling engine 100 includes the crankshaft 110, and members and mechanisms (for instance, the piston 20 and the approximate linear mechanism 60) that are coupled, directly or indirectly, to the crankshaft 110, and which execute during the operation of the Stirling engine 100 a rotational motion or a reciprocating motion accompanying the rotation of the crankshaft 110. The rotational system of the Stirling engine 100 stores inertial energy through rotation of the crankshaft 110, which is driven by an external driving force (inertial energy generated through rotation of the crankshaft 110). That is, the inertial energy stored in the rotational system of the Stirling engine 100 becomes greater as the rotational speed of the crankshaft 110 increases. The piston 20 can execute a reciprocating motion within the cylinder 30 when the inertial energy stored in the rotational system of the Stirling engine 100 exceeds the maximum pressure, exerted by the piston 20, of the actuating fluid in the actuating fluid space MS, whereupon continued rotation by the crankshaft 110 allows the Stirling engine 100 to start up and begin running.

Upon startup of the Stirling engine 100, the ECU 50 illustrated in FIG. 1 determines whether or not the Stirling engine 100 is in a start-enabling condition. For instance, the ECU 50 determines that the Stirling engine 100 is in a start-enabling condition when the temperature of the exhaust gas Ex is at or above a predetermined temperature. When the Stirling engine 100 is in a start-enabling condition, the ECU 50 opens the passage opening/closing valve 41, whereupon an external driving force, for instance a starter motor, causes the crankshaft 110 to rotate. The ECU 50 detects the rotational speed of the crankshaft 110 of the Stirling engine 100 by way of a crank angle sensor 140 illustrated in FIG. 1.

When the ECU 50 determines that the rotational speed of the crankshaft 110 is equal to or greater than the start-enabling rotational speed N0, the ECU 50 closes the passage opening/closing valve 41, thereby discontinuing the rotation of the crankshaft 110 by an external driving force. The Stirling engine 100 starts up as a result, and begins running independently. After startup of the Stirling engine 100, i.e. after the rotational speed of the crankshaft 110 of the Stirling engine 100 exceeds N0 (from time t0 onwards in FIGS. 5A and 5B), the rotational speed, of the crankshaft 110 rises up to a rated rotational speed Nc, at which there is obtained a rated output Wc of the Stirling engine 100 (from timed t1 onwards in FIGS. 5A and 5B).

Upon startup of the Stirling engine 100 in the embodiment 1, therefore, the passage opening/closing valve 41 is opened to cause the actuating fluid space MS and the crankcase inner space CS to communicate with each other via the fluid passage 40, as a result of which there is reduced the force for causing the piston 20 to move reciprocally by way of the crankshaft 110. In that state, the crankshaft 110 of the Stirling engine 100 is caused to rotate by an external driving force. Inertial energy becomes stored as a result in the rotational system of the Stirling engine 100, which starts up by tapping the stored inertial energy. The above configuration in the embodiment 1 allows reducing the starting torque of the Stirling engine 100, and makes it therefore unnecessary to provide a start means having substantial torque. This translates into reduced costs. Although transmission torque is small when the driving force is extracted from the crankshaft 110 by way of a contactless driving force transmission mechanism such as a magnetic coupling, the embodiment 1 allows reducing the starting torque, thanks to the above-described configuration, and hence the embodiment is suitable for instances where such driving force transmission mechanisms are employed.

(Configuration of the Fluid Passage)

Figure 6A:
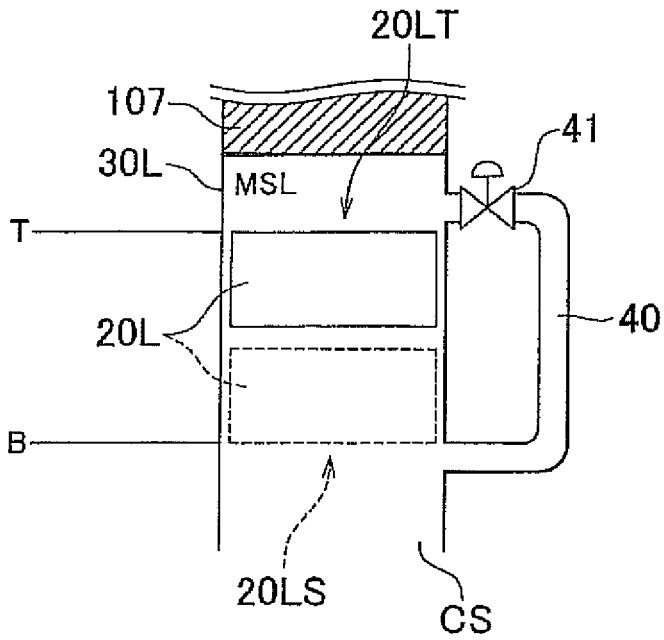
FIG. 6A is an explanatory diagram illustrating the configuration of a fluid passage in the Stirling engine according to Embodiment 1.
Figure 6B:
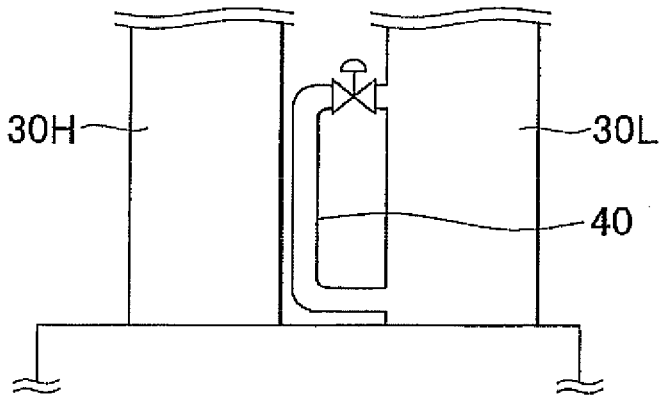
FIG. 6B is an explanatory diagram illustrating the configuration of a fluid passage in the Stirling engine according to Embodiment 1.

FIGS. 6A and 6B are diagrams for explaining the configuration of a fluid passage in the Stirling engine according to Embodiment 1. In the Stirling engine 100, the actuating fluid, heated in the heater 105 by the exhaust gas Ex streaming around the heater 105, flows into the high temperature-side cylinder 30H. Providing the fluid passage 40 in the high temperature-side cylinder 30H might cause the heated actuating fluid to get into the crankcase inner space CS via the fluid passage 40, and may result in a drop of the output of the Stirling engine 100 immediately after closing of the passage opening/closing valve 41. In the embodiment 1, therefore, the fluid passage 40 is provided in the low temperature side cylinder 30L, as illustrated in FIGS. 6A and 1. This allows preventing the output of the Stirling engine 100 from dropping immediately after closing of the passage opening/closing valve 41.

As illustrated in FIG. 6A, the fluid passage 40 connects a portion closer to the cooler 107 than the top dead center of the low temperature-side piston 20L with a portion closer to the crankcase inner space CS than the bottom dead center of the low temperature-side piston 20L. Specifically, the opening of the fluid passage 40 on the side of the low temperature-side actuating fluid space MSL (corresponding to the first space) is provided above the top dead center of the low temperature-side piston 20L, more specifically, closer to the cooler 107 than a top face 20LT of the low temperature-side piston 20L when the latter is at the top dead center (position denoted by T in FIG. 6A). The opening of the fluid passage 40 on the side of the crankcase inner space CS (corresponding to the second space) is provided below the bottom dead center of the low temperature-side piston 20L, more specifically, closer to the crankcase inner space CS than a skirt side end 20LS of the low temperature-side piston 20L when the latter is at the bottom dead center (position denoted by B in FIG. 6A)

The above configuration allows keeping to an essential minimum the length of the fluid passage 40, so that pressure losses of the actuating fluid when the latter flows through the fluid passage 40 can be reduced. This reduces the pressure loss of the actuating fluid that flows through the fluid passage 40 when the passage opening/closing valve 41 is open, i.e. during startup of the Stirling engine 100. As a result, the torque required for starting the Stirling engine 100 can be further reduced.

Although the passage opening/closing valve 41 is closed during operation of the Stirling engine 100, the actuating fluid flows into the volume between the opening (opening on the side of the actuating fluid space) of the fluid passage 40 on the side of the low temperature-side actuating fluid space MSL (corresponding to the first space) up to the passage opening/closing valve 41. This actuating fluid within the fluid passage 40 does not contribute to the output of the Stirling engine 100, and hence the volume from the opening of side of the actuating fluid space up to the passage opening/closing valve 41 is preferably as small as possible. In the embodiment 1, as illustrated in FIG. 6A, the passage opening/closing valve 41 is disposed in the vicinity of the opening on the side of the actuating fluid space. In the embodiment 1, therefore, the volume from the opening on the side of the actuating fluid space up to the passage opening/closing valve 41 is kept to a minimum. This allows preventing a decrease in the amount of actuating fluid that contributes to the output of the Stirling engine 100.

The fluid passage 40 may be disposed between the high temperature-side cylinder 30H and the low temperature side cylinder 30L, as Illustrated in FIG. 6B. This results in a compact Stirling engine 100 and allows preventing the fluid passage 40 and the passage opening/closing valve 41 from protruding out of the Stirling engine 100.

Embodiment 2

Embodiment 2 is similar to Embodiment 1, but differs from the latter in that in Embodiment 1, the Stirling engine starts with the passage opening/closing valve in an open state, and the passage opening/closing valve is closed when the rotational speed of the Stirling engine reaches a rotational speed at which the piston and the cylinder are not in contact.

Figure 7:
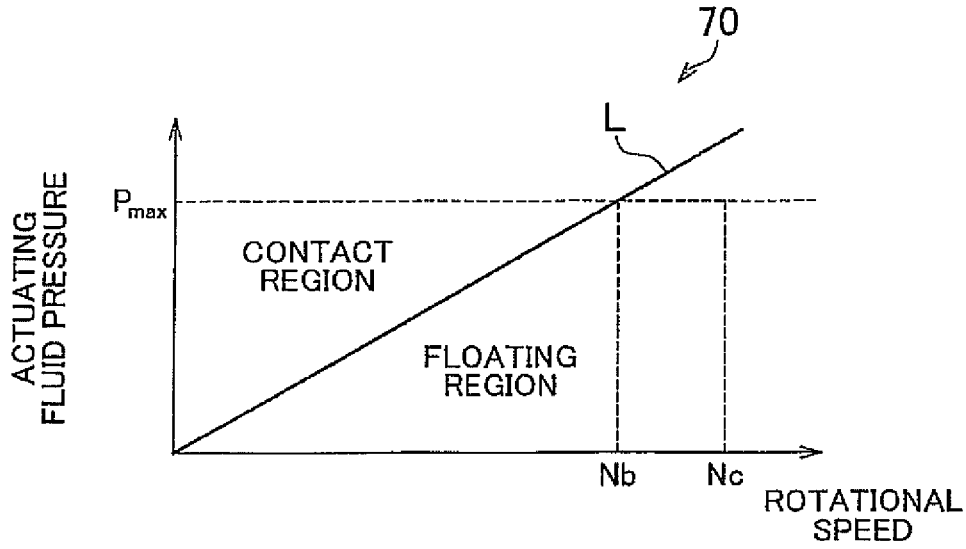
FIG. 7 is a conceptual diagram illustrating a map for discriminating between a floating region and a contact region of a piston in a structure wherein a piston is supported in a cylinder by way of a gas bearing.

FIG. 7 is a conceptual diagram illustrating a map for discriminating between a floating region and a contact region of a piston in a structure wherein a piston is supported in a cylinder by way of a gas bearing. In the map 70 of FIG. 7, the vertical axis represents the pressure of the actuating fluid in the actuating fluid space MS of the Stirling engine 100 illustrated in FIG. 1, and the horizontal axis represents the rotational speed of the crankshaft 110 of the Stirling engine 100.

The straight line L in the map 70 demarcates a region at which the piston 20 and the cylinder 30 of the Stirling engine 100 come into contact with each other (contact region), and a region at which the piston 20 floats in the cylinder 30 by way of the gas bearing or a region of allowable contact between the piston 20 and the cylinder 30 (floating region). For a given rotational speed, the region where the pressure of the actuating fluid is higher than the straight line L is the contact region, and the region where the pressure of the actuating fluid is lower than the straight line L is the floating region. For a given actuating fluid pressure, the region at which the rotational speed is lower than the straight line L is the contact region, and the region at which the rotational speed is higher than the straight line L is the floating region. The relationship of the map 70 is a novel finding obtained through experimentation for finding a region at which the piston 20 floats in the cylinder 30. In the embodiment 2, as described above, the floating region includes conceptually not only a region at which the piston 20 floats in the cylinder 30 by way of the gas bearing, but also a region at which there occurs allowable contact between the piston 20 and the cylinder 30. Preferably, the floating region is the region at which the piston 20 floats in the cylinder 30 by way of the gas bearing.

The maximum actuating fluid pressure Pmax is the maximum pressure of the actuating fluid in the actuating fluid space MS, i.e. the first space, of the Stirling engine 100. The maximum actuating fluid pressure Pmax is determined by the specifications of the Stirling engine 100, so that the pressure of the actuating fluid in the actuating fluid space MS cannot be greater than the maximum actuating fluid pressure Pmax. Therefore, the region in the map 70 at which the rotational speed is greater than the rotational speed Nb of the crankshaft 110, at the intersection point of the straight line L and the maximum actuating fluid pressure Pmax, is of necessity the floating region. That is, when the rotational speed of the crankshaft 110 is greater than the rotational speed Nb, the piston 20 floats in the cylinder 30. In the embodiment 2, therefore, the region at which the piston 20 floats in the cylinder 30, and the region at which the piston 20 comes into contact with the cylinder 30 are determined on the basis of a relationship between the pressure of the actuating fluid in the actuating fluid space MS and the engine rotational speed of the Stirling engine 100 (rotational speed of the crankshaft 110).

To start the Stirling engine 100 in the embodiment 2, the ECU 50 illustrated in FIG. 1 opens the passage opening/closing valve 41, whereupon the crankshaft 110 is rotated by an external driving force. The ECU 50 leaves open the passage opening/closing valve 41 illustrated in FIG. 1 until attainment of a rotational speed at which the piston 20 and the cylinder 30 are not in contact, i.e. a rotational speed in the floating region (for instance Nb, referred to as the piston floating rotational speed). The rotational speed Nb is the boundary between the floating region and the contact region. Preferably, a rotational speed greater than the rotational speed Nb is set as the piston floating rotational speed and the passage opening/closing valve 41 is closed at that rotational speed, in order to avoid contact between the piston 20 and the cylinder 30 more reliably thereby.

The ECU 50 compares the floating rotational speed with the rotational speed of the crankshaft 110 as acquired by the crank angle sensor 140 illustrated in FIG. 1. When the ECU 50 determines that the rotational speed of the crankshaft 110 is equal to or greater than the floating rotational speed, the ECU 50 closes the passage opening/closing valve 41, and discontinues the rotation of the crankshaft 110 by an external driving force. The Stirling engine 100 starts up as a result, and begins running independently. Once the Stirling engine 100 has started, the ECU 50 raises the rotational speed of the crankshaft 110 up to a rated rotational speed Nc, to obtain a rated output from the Stirling engine 100.

In the embodiment 2, therefore, the Stirling engine 100 can start with the piston 20 floating reliably off the cylinder 30, and hence the Stirling engine 100 can run while avoiding contact between the piston 20 and the cylinder 30. This ensures sufficient durability of the piston 20, which in turn increases the reliability of the Stirling engine 100.

As described above, the piston engine according to the embodiments is useful for starting a piston engine in which an actuating fluid space is filled with an actuating fluid.

What is claimed is:

1. A piston engine, comprising:

a first cylinder;

a first piston that moves reciprocally in the first cylinder;

a second cylinder;

a second piston that moves reciprocally in the second cylinder wherein the piston engine converts the reciprocating motion of the first and second pistons into rotational motion and outputs the rotational motion;

a fluid passage that connects a first space formed in the first or second cylinder and filled with an actuating fluid, with a second space on an opposite side of the first or second piston to the first space;

a passage opening/closing portion that is provided in the fluid passage, and the passage opening/closing portion switches between communication and non-communication through the fluid passage, wherein the passage opening/closing portion enables communication through the fluid passage upon startup of the piston engine, and shuts off communication through the fluid passage when a rotational speed of the piston engine is equal to or greater than a predetermined rotational speed; and a regenerator passage connecting the first and second cylinders including a heat exchanger configured by a heater that heats the actuating fluid, the heat exchanger being connected to the first cylinder so that the actuating fluid flows in and out of the heater, a regenerator connected to the heater so that the actuating fluid flows in and out of the regenerator, and a cooler that cools the actuating fluid, the cooler having one end connected to the regenerator and the other end connected to the second cylinder so that the actuating fluid flows in and out of the cooler.

2. The piston engine according to claim 1, wherein the predetermined rotational speed is a start-enabling rotational speed at which the piston compresses the actuating fluid, in a state where communication through the fluid passage is shut off, and at which an inertial energy of the rotational system of the piston engine that corresponds to a magnitude in excess of a maximum pressure of the actuating fluid can be obtained.

3. The piston engine according to claim 1, wherein upon startup of the piston engine, the piston engine is placed in a virtually load-less state, and the passage opening/closing portion opens the fluid passage until attainment of a rotational speed at which the piston and the cylinder are not in contact.

4. The piston engine according to claim 1, wherein the passage opening/closing portion is provided at a position closer to a connection portion between the first space and the fluid passage than a connection portion between the second space and the fluid passage.

5. The piston engine according to claim 1, wherein the piston engine is a Stirling engine;

a gas bearing is interposed between the first cylinder and the first piston, and between the second cylinder and the second piston; and the fluid passage connects a portion closer to the cooler than a top dead center of the second piston and a portion closer to the second space than a bottom dead center of the second piston.

6. The piston engine according to claim 5, wherein the predetermined rotational speed is a start-enabling rotational speed at which the piston compresses the actuating fluid, in a state where communication through the fluid passage is shut off, and at which an inertial energy of the rotational system of the piston engine that corresponds to a magnitude in excess of a maximum pressure of the actuating fluid can be obtained.

7. The piston engine according to claim 5, wherein upon startup of the piston engine, the piston engine is placed in a virtually load-less state, and the passage opening/closing portion opens the fluid passage until attainment of a rotational speed at which the piston and the cylinder are not in contact.

8. The piston engine according to claim 5, wherein the passage opening/closing portion is provided at a position closer to the cooler than the second space.

9. The piston engine according to claim 5, wherein the fluid passage is disposed between the first cylinder and the second cylinder.

* * * * *